United States Patent [19]

Yasukawa

[11] Patent Number: 4,690,104

[45] Date of Patent: Sep. 1, 1987

[54] CYLINDER HEAD WITH INWARDLY PROJECTING CUP PLUG IN CASTING SAND EXTRACTION HOLE FOR SPEEDING UP COOLANT FLOW

[75] Inventor: Masao Yasukawa, Toyota, Japan

[73] Assignee: Toyota Jidosha Kabushiki Kaisha, Aichi, Japan

[21] Appl. No.: 864,086

[22] Filed: May 16, 1986

[30] Foreign Application Priority Data

May 24, 1985 [JP] Japan ..... 60-111776

[51] Int. Cl.[4] ..... F01P 3/02

[52] U.S. Cl. ..... 123/41.32; 123/41.79; 123/41.82 R

[58] Field of Search ..... 123/41.73, 41.74, 41.79, 123/41.82 R, 193 H, 41.32; 29/156.4 R

[56] References Cited

U.S. PATENT DOCUMENTS 3,353,522 11/1967 Ley ..... 123/41.79

4,579,091 4/1986 Kashiwagi et al. ..... 123/41.82 R

FOREIGN PATENT DOCUMENTS 2139285 11/1984 United Kingdom ..... 123/41.82 R

*Primary Examiner*—William A. Cuchlinski, Jr.

*Attorney, Agent, or Firm*—Kenyon & Kenyon

[57] ABSTRACT

A cylinder head for an automotive vehicle has an inner wall serving to define the roofs of combustion chambers, and an outer wall spaced outward therefrom. A coolant flow plenum is defined between the inner wall and the outer wall, and a coolant flow path is defined through the coolant flow plenum. A hole through a portion of the outer wall of the cylinder head opens to a portion of the coolant flow path which has a relatively large cross sectional area, and serves for extracting an inner casting sand core used to create the coolant flow plenum during casting of the cylinder head. A cup plug is fitted into the casting sand extraction hole so as to block it, and this cup plug projects inwards into the coolant flow plenum so as to constrict the large cross section portion of the coolant flow path and to deflect flow of coolant toward other portions of the cylinder head that require high cooling.

7 Claims, 2 Drawing Figures

CYLINDER HEAD WITH INWARDLY PROJECTING CUP PLUG IN CASTING SAND EXTRACTION HOLE FOR SPEEDING UP COOLANT FLOW

BACKGROUND OF THE INVENTION

The present invention relates to a cylinder head, and more particularly relates to a cylinder head with a construction for a coolant plenum formed in it, which provides improved coolant flow and improved cylinder head cooling effect.

A typical cylinder head for an internal combustion engine is formed by casting, and has an inner wall, an outer wall and side walls, with a coolant plenum being defined between said inner wall and said outer wall. Coolant circulates through this coolant plenum from an inlet thereof to an outlet thereof, generally over the inner cylinder head wall which defines the roofs of the combustion chambers of the engine as well as past various structures such as walls enclosing spark plug holes for the spark plugs for the engine cylinders, bosses for slidably receiving intake and exhaust valves of the engine, bulges for defining intake and exhaust ports of the engine, and so on; and thereby this coolant flow cools these structures.

A problem that has arisen in this connection is that it is desirable to have such coolant flows over respective coolant paths defined in the coolant plenum that ensure a uniform temperature over various portions; but, due to the profusion of various structures such as those detailed above which restrict the cross sections of the coolant paths therearound, inevitably some other portions of said coolant paths come to be of undesirably greater cross sectional area. This means that the flow speed at these portions of the greater cross section is relatively lower than in other portions, and thereby not enough cooling action is available at these portions. This can cause hot spots to develop within the combustion chambers of the engine at locations corresponding to these coolant path portions, which can lead to problems with lubrication and deterioration of engine durability, as well as to knocking and loss of mechanical octane value of the engine or preignition of the fuel.

In the prior art, for example in Japanese Patent Application Ser. No. 55-52286 (1980) which was published as Japanese Patent Laying Open Publication Ser. No. 56-148647, there have been proposed to form projections which stick out into and obstruct those portions of the coolant paths where said coolant paths would otherwise be of undesirably large cross sectional area. Thereby, the above mentioned problems can in principle be resolved, but such projections have been in the prior art relatively hard to manufacture. The coolant plenum is typically formed by the use of a casting sand inner core during the casting process of the cylinder head, and, whether the projections are cast integrally with the cylinder head or are cast as inclusions into said cylinder head (which entails an undesirable increase in the number of parts for manufacturing the cylinder head), it is difficult to manufacture them economically. Accordingly, mass production of such a cylinder head at a reasonable cost level has been impracticable.

SUMMARY OF THE INVENTION

Meanwhile, it has occurred to the present inventors that in any case a relatively large hole needs to be provided through the outer wall of the cylinder head for extracting or removing the casting sand that has been used for constituting the casting core to define the cooling plenum inside the cylinder head, after said cylinder head has once been cast. And, in any case, a plug is typically fitted into said casting sand extraction hole, so as to seal the coolant plenum to prevent escape of coolant therefrom. And it has occurred to the present inventors that this casting sand extraction hole and plug therefor, which in any case are required to be provided, might be taken advantage of for providing such coolant path cross sectional area reducing protuberances.

Accordingly, it is the primary object of the present invention to provide a cylinder head which avoids the above described problems.

It is a further object of the present invention to provide such a cylinder head, in the coolant plenum of which such projections for reducing the cross sectional area of coolant flow paths therethrough are simply provided without the need for any special manufacturing process such as inclusion casting.

It is a further object of the present invention to provide such a cylinder head, which can easily be efficiently and effectively cooled.

It is a further object of the present invention to provide such a cylinder head, which is easy to manufacture.

It is a further object of the present invention to provide such a cylinder head, which does not have an unduly large number of component parts.

It is a further object of the present invention to provide such a cylinder head, which is economical to manufacture.

It is a yet further object of the present invention to provide such a cylinder head, which is well suited for mass production.

It is a yet further object of the pesent invention to provide such a cylinder head, which has a good and uniform coolant flow pattern.

It is a further object of the present invention to provide such a cylinder head, in the coolant plenum of which coolant flow paths therethrough do not have any very considerable portions of unduly large cross sectional area.

It is a yet further object of the present invention to provide such a cylinder head, which is not prone to the development of combustion chamber hot spots.

It is a yet further object of the present invention to provide such a cylinder head, which helps to maintain good engine lubrication.

It is a yet futher object of the present invention to provide such a cylinder head, which helps to maintain good engine durability.

It is a yet further object of the present invention to provide such a cylinder head, which helps to prevent engine knocking.

It is a yet further object of the present invention to provide such a cylinder head, which helps to prevent engine preignition.

It is a yet further object of the present invention to provide such a cylinder head, which allows the engine to which it is assembled to have a high mechanical octane value.

According to the most general aspect of the present invention, these and other objects are accomplished by a cylinder head for an internal combustion engine having combustion chambers, the cylinder head comprising: (a) an inner wall serving to define roofs of said combustion chambers; (b) an outer wall; (c) a coolant flow plenum being defined between said inner wall and said outer wall, with a coolant flow path being defined through said coolant flow plenum; (d) a casting sand extraction hole being defined through a portion of said outer wall of said cylinder head and opening to a portion of said coolant flow path which has a relatively large cross sectional area; and (e) a cup plug fitted into said casting sand extraction hole so as to block it, wherein said cup plug projects inwards into said coolant flow plenum so as to constrict said portion of said coolant flow path.

According to the present invention as described above, there is provided a cylinder head, in the coolant plenum of which a projection for reducing the cross sectional area of the coolant flow path therethrough is simply provided without the need for any special manufacturing process such as inclusion casting, only by the cup plug, which in any case is required for blocking the casting sand extraction hole, being formed to project inwards into said coolant flow plenum so as to constrict a portion of the coolant flow path which otherwise has a relatively large cross-sectional area. Thereby, the cylinder head can easily be efficiently and effectively cooled, while still remaining easy and economical to manufacture, for example by mass production, and without being handicapped by requiring an unduly large number of component parts. This cylinder head has a good and uniform coolant flow pattern, and in its coolant plenum the coolant flow paths therethrough do not have any very considerable portions of unduly large cross-sectional area. Accordingly, this cylinder head is not prone to the development of combustion chamber hot spots, good engine lubrication and durability are assured, and engine knocking and preignition are inhibited. Accordingly, the engine to which this cylinder head is assembled is allowed and encouraged to have a high mechanical octane value.

BRIEF DESCRIPTION OF THE DRAWINGS

The present invention will now be shown and described with regard to the preferred embodiment thereof, and with reference to the illustrative drawings, which however should not be considered as limiting the present invention in any way, since the scope of the present invention is to be considered as being delimited solely by the accompanying claims, rather than by any particular features of the disclosed embodiment or of the drawings. In these drawings:

DESCRIPTION OF THE PREFERRED EMBODIMENT

Figure 1:
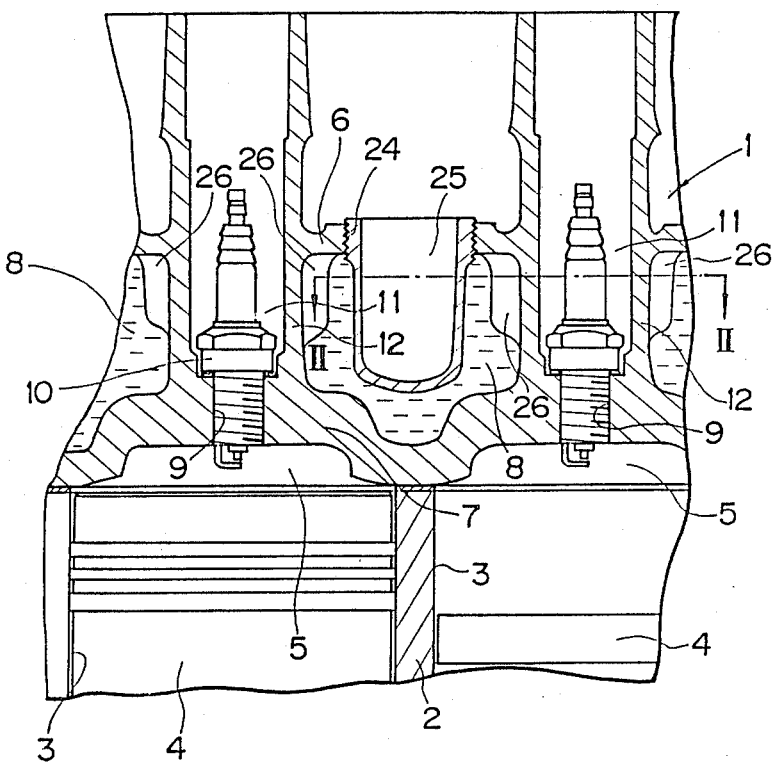
FIG. 1 is a partial vertical longitudinal sectional view taken through an internal combustion engine comprising a cylinder block and a cylinder head which is the preferred embodiment of the cylinder head of the present invention.
Figure 2:
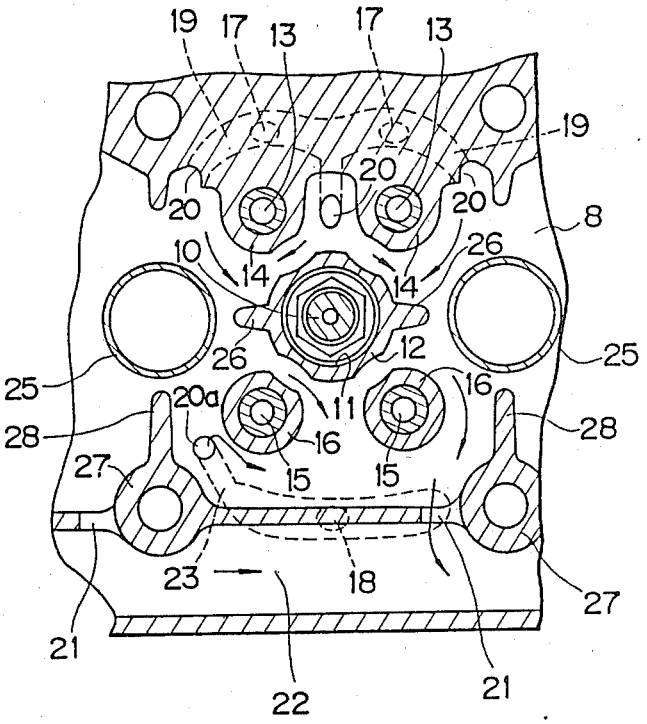
FIG. 2 is a partial horizontal sectional view taken through said preferred embodiment cylinder head in a plane indicated by the arrows II—II in FIG. 1.

The present invention will now be described with reference to the preferred embodiment thereof. FIG. 1 is a partial vertical longitudinal sectional view taken through an internal combustion engine comprising a cylinder block and a cylinder head which is the preferred embodiment of the present invention, while FIG. 2 is a horizontal sectional view of said cylinder head. In these figures, the reference numeral 1 denotes the cylinder head, which is mounted to the cylinder block denoted by 2. This cylinder block 2 is formed with a plurality of cylinder bores 3, in each of which a piston 4 reciprocates in a per se known manner, whereby combustion chambers 5 are defined between said pistons 4 and the cylinder head 1.

This cylinder head 1 is formed with an outer wall portion 6 which defines the outer surface of said cylinder head 1 and which is open to the outside and an inner wall portion 7 which defines the inner surface of said cylinder head 1 and which roofs over the combustion chambers 5. Between this outer wall portion 6 and this inner wall portion 7 there is defined a coolant circulation plenum 8, which is formed during casting of the cylinder head 1 by the provision of a casting sand core mold which is removed afterwards in a manner which will be explained shortly. In each combustion chamber 5, a threaded cylindrical spark plug hole 9 is formed through the inner wall portion 7 which roofs over said combustion chambers 5, and a per se known spark plug 10 is screwed into said spark plug hole 9 and is received in a spark plug guide hole 11 defined within a cylindrical wall 12 which extends from the inner wall portion 7 past the outer wall portion 6 to the outside. Thereby, the spark plugs 10 may be freely accessed from the outside of the cylinder head through the open ends of their spark plug guide holes 11, the cylinderical walls 12 of which define sides of the coolant circulation plenum 8.

Two intake valves and two exhaust valves, none of them particularly shown in the figures, are provided for each of the combustion chambers 5, and are of the per se known poppet type construction. As partially shown in section in FIG. 2, the stems 13 of these intake valves are supported in intake valve guide bosses 14 which pass through the coolant circulation plenum 8 from the side of the inner wall portion 7 to the side of the outer wall portion 6 thereof, and the stems 15 of the exhaust valves are supported in exhaust valve guide bosses 16 which similarly pass through the coolant circulation plenum 8 from the side of the inner wall portion 7 to the side of the outer wall portion 6 thereof. As shown in FIG. 2, in the configuration of this shown preferred embodiment, the cylindrical wall 12 for the guide hole 11 for the spark plug 10 of each combustion chamber 5 lies in the approximate center of a square defined by the two intake valve guide bosses 14 and the two exhaust valve guide bosses 15 for the intake and exhaust valves of said combustion chamber 5.

Coolant is supplied to the coolant circulation plenum 8 as follows, through passages shown by dashed lines in FIG. 2 because they actually lie behind surfaces visible in said figure. On the intake valve side, from a coolant supply passage not shown, through supply passages 17 and distribution passages 19, coolant passes through coolant input holes 20 into said coolant circulation plenum 8 between each pair of intake valve guide bosses 14 and also on the outer sides of said valve guide bosses 14, as shown by the arrows in the figure. And, on the exhaust valve side, from a coolant supply passage not shown, through supply passages 18 and distribution passages 23, coolant passes through coolant input holes **20*a* into said coolant circulation plenum 8 near each pair of exhaust valve guide bosses 16, as similarly shown by the arrows in the figure. The coolant thus supplied into the coolant circulation plenum 8 is drained therefrom through exit holes 21 in the side wall thereof, to pass into a coolant exhaust gallery 22**.

Thus, for each combustion chamber 5, the coolant supplied through the coolant input holes 20 into said coolant circulation plenum 8 between and around the intake valve guide bosses 14 therefor first flows around said intake valve guide bosses 14, thus cooling them, then flows around the cylindrical wall 12 of the guide hole 11 for the spark plug 10 for this cylinder, thus cooling the roof portion of this combustion chamber 5, and then flows around the exhaust valve guide bosses 16 of this combustion chamber 5, thus cooling them likewise, and finally flowing out through the exit holes 21, as shown by the arrows in FIG. 2. The wall structure of the cylinder head which forms the coolant circulation plenum has portions that define a region between the cylinder chambers which does not require very much cooling, this region having much more open space with a much greater cross section than the portions of the plenum on top of each cylinder chamber 5. Consequently, this region would tend to receive more coolant flow, while bypassing the coolant away from those portions on the tope of each cylinder chamber which require much more cooling.

However, according to the present invention, the openings 24 in the outer wall portion 6 (through which the casting sand core used for defining the coolant circulation plenum 8 was removed after casting and which accordingly must in any case be provided) are threaded and then are blocked with inwardly extending cup plugs 25 screwed thereinto. Said cup plugs 25 reach nearly to the inner wall portion 7 of the cylinder head 1, thus largely restricting the aforesaid portions of the coolant flow path pattern between the cylinder chambers 5 and reducing their cross section. As a result, the flow of coolant therethrough is reduced, and a large portion of the flow of coolant is diverted toward the central portion on the top of each cylinder chamber. According to this inventive concept, the openings 24 are made to be relatively large, and the cup plugs 25 are relatively large in diameter and deep in extent. In particular, the openings 24 with their cup plugs 25 are located between the cylindrical walls 12 of the guide holes 11 for the spark plugs 10, thus effectively guiding the coolant flow around said cylindrical walls 12. In this way, projections which are desired to be provided in the coolant circulation plenum 8 for reducing the cross sectional area of the coolant flow paths at vacant portions between adjacent cylindrical walls 12 for the spark plugs are provided, without the need for any special manufacturing process such as inclusion casting, solely by the cup plugs 25. Such plugs are required in any case for blocking the casting sand extraction holes 24, but according to the present invention they are formed to project inwards into said coolant circulation plenum 8 so as to constrict said coolant flow path at the appropriate portions thereof which otherwise would have relatively large cross-sectional areas. Thereby, all portions of the cylinder head 1 can be efficiently and desirably cooled, while the head still remains easy and economical to manufacture, for example by mass production, without being handicapped by requiring an unduly large number of component parts. And this cylinder head 1 can be designed to provide a good coolant flow pattern which supplies more coolant to those portions which need more cooling. Accordingly, this cylinder head 1 is not prone to the development of combustion chamber hot spots, good engine durability is assured, and engine knocking and preignition are inhibited. As a result, the engine to which this cylinder head 1 is assembled can be designed to have a high mechanical octane value.

Further, according to a specialization of the inventive concept of the present invention, fin portions 26 are formed as extending out from the outer surfaces of the cylindrical walls 12 of the guide holes 11 for the spark plugs 10, towards the cup plugs 25, thus coacting with the cup plugs 25 to even further increase the cooling effect provided by the flow of coolant guided around said cylindrical walls 12. These fin portions 26 are particularly formed on the outer portions of the cylindrical walls 12, as shown best in FIG. 1. And further, as shown in FIG. 2, fin portions 28 are formed as extending out from the outer surfaces of boss portions 27 for passing cylinder head bolts, not shown, which secure the cylinder head 2 to the cylinder block 1. These fins 28 also extend nearly to the cup plugs 25 and function to guide the flow of coolant to pass past the exhaust valve guide bosses 16 for each combustion chamber 5, while substantially stopping said coolant flow from flowing directly to the coolant exit hole 21 for the neighboring cylinder.

While the cup plugs 25 extend into the coolant circulation plenum 8 enough to deflect the flow of coolant therein toward the cylindrical walls 12 of the guide holes 11 for the spark plugs 10, the ends of the plugs are spaced from the inner wall portion 7 so as to leave flow passages for the coolant large enough to ensure necessary cooling of the inner wall portion 7 at portions located between two adjacent combustion chambers.

Although the present invention has been shown and described in terms of the preferred embodiment thereof, and with reference to the appended drawings, it should not be considered as being particularly limited thereby. The details of any particular embodiment, or of the drawings, could be varied without, in many cases, departing from the ambit of the present invention. Accordingly, the scope of the present invention is to be considered as being delimited, not by any particular perhaps entirely fortuitous details of the disclosed preferred embodiment, or of the drawings, but solely by the legitimate and properly interpreted scope of the accompanying claims, which follow.

What is claimed is:

1. A cylinder head for an internal combustion engine having combustion chambers, the cylinder head comprising:

(a) an inner wall serving to define roofs of combustion chambers of the internal combustion engine;

(b) an outer wall spaced from the inner wall, the inner and outer walls defining a coolant plenum between said inner wall and said outer wall, with a coolant flow path being defined through said coolant plenum, and said outer wall having a casting sand extraction hole extending through said outer wall and opening to a region of said coolant plenum which has a cross-sectional area that is substantially larger than the cross-sectional area of said coolant flow path in a portion of the coolant plenum adjacent to said region; and (c) a cup plug fitted into said casting sand extraction hole so as to block said hole, said cup plug projecting inwards into said coolant flow plenum so far as to reach nearly to said inner wall but to leave a coolant flow passage between the plug and the inner wall, thereby substantially reducing the cross-sectional area of said region of said coolant plenum.

2. A cylinder head according to claim 1, wherein an inner periphery of said casting sand extraction hole is threaded, and said cup plug is formed with a thread which engages with said threaded inner periphery of said casting sand extraction hole to hold said cup plug in said casting sand extaction hole so as to block said hole.

3. A cylinder head according to claim 1, further comprising a cylindrical wall extending through said coolant plenum from a cylinder roof of said inner wall of said cylinder head through said outer wall thereof to define a spark plug receiving hole therein, said cup plug being arranged adjacent to said cylindrical wall.

4. A cylinder head for an internal combustion engine having combustion chambers, the cylinder head comprising:

(a) an inner wall serving to define roofs of combustion chambers of the internal combustion engine;

(b) an outer wall spaced from the inner wall, the inner and outer walls defining a coolant plenum between said inner and said outer wall, with a coolant flow path being defined through said coolant plenum, and said outer wall having a casting sand extraction hole extending through said outer wall and opening to a region of said coolant plenum which has a relatively large cross-sectional area;

(c) a cup plug fitted into said casting sand extraction hole so as to block said hole, said cup projecting inwards into said coolant plenum so as to constrict the coolant flow path in said region of the coolant plenum;

(d) a first cylindrical wall extending through said coolant plenum from said inner wall of said cylinder head through said outer wall thereof to define a spark plug receiving hole therein, said cup plug being arranged adjacent to said cylindrical wall; and wherein a second spark plug receiving cylindrical wall is provided in spaced relation to the first cylindrical wall, and said cup plug is located between said first and second spark plug receiving cylindrical walls.

5. A cylinder head according to claim 4, wherein the outer surface of said spark plug receiving cylindrical wall is formed with a fin protruding towards said cup plug.

6. A cylinder head according to claim 5, wherein said fin is formed on a portion of said spark plug receiving cylindrical wall adjacent said outer wall of said cylinder head and away from said inner wall of said cylinder head.

7. A cylinder head according to claim 5, further comprising a fin which is formed on a portion of a side wall defining surface of said coolant flow plenum of said cylinder head so as to protrude towards said cup plug.

* * * * *